US008122871B2

(12) United States Patent
Tashima et al.

(10) Patent No.: US 8,122,871 B2
(45) Date of Patent: Feb. 28, 2012

(54) FUEL SUPPLY DEVICE FOR INTERNAL COMBUSTION ENGINE AND CONTROL DEVICE FOR THE FUEL SUPPLY DEVICE

(75) Inventors: Kazuchika Tashima, Anjo (JP); Toshio Yoshidome, Toyota (JP); Hiromasa Suzuki, Toyota (JP); Seiji Iwashita, Okazaki (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 352 days.

(21) Appl. No.: 12/518,281

(22) PCT Filed: Dec. 18, 2007

(86) PCT No.: PCT/JP2007/074288

§ 371 (c)(1),
(2), (4) Date: Jun. 9, 2009

(87) PCT Pub. No.: WO2008/075668

PCT Pub. Date: Jun. 26, 2008

(65) Prior Publication Data

US 2010/0006072 A1 Jan. 14, 2010

(30) Foreign Application Priority Data

Dec. 20, 2006 (JP) ..... 2006-343341

(51) Int. Cl.
*F02M 37/08* (2006.01)
*F02M 37/00* (2006.01)

(52) U.S. Cl. ..... 123/514

(58) Field of Classification Search ..... 123/511, 123/514, 461, 509, 456, 447, 179.17, 506; 701/104

See application file for complete search history.

(56) References Cited

U.S. PATENT DOCUMENTS

| | | | | | |
|---|---|---|---|---|---|
| 5,207,203 | A | * | 5/1993 | Wagner et al. | 123/514 |
| 5,425,342 | A | * | 6/1995 | Ariga et al. | 123/456 |
| 5,558,068 | A | * | 9/1996 | Kunishima et al. | 123/516 |
| RE36,119 | E | * | 3/1999 | Kunishima et al. | 123/516 |
| 6,142,120 | A | * | 11/2000 | Biester et al. | 123/456 |
| 2003/0041842 | A1 | | 3/2003 | Kumagai et al. | |

FOREIGN PATENT DOCUMENTS

| | | |
|---|---|---|
| JP | 5 59976 | 3/1993 |
| JP | 9 158766 | 6/1997 |
| JP | 9 242632 | 9/1997 |
| JP | 2001 152999 | 6/2001 |
| JP | 2001 182588 | 7/2001 |
| JP | 2001 221085 | 8/2001 |
| JP | 2002-4965 | 1/2002 |
| JP | 2003 83191 | 3/2003 |

* cited by examiner

*Primary Examiner* — Mahmoud Gimie
(74) *Attorney, Agent, or Firm* — Oblon, Spivak, McClelland, Maier & Neustadt, L.L.P.

(57) ABSTRACT

A fuel supply device has a main line, a fuel pump, a first return line, a second return line, a valve mechanism, a first pressure regulator, and a second pressure regulator. The fuel pump pressurizes the fuel in the fuel tank and supplies the fuel to a fuel distribution pipe via the main line. The first return line returns the fuel from the fuel distribution pipe to the fuel tank. The second return line is branched from the main line and returns the fuel from the main line to the fuel tank. The valve mechanism selectively connects and disconnects the second return line with respect to the main line. The first pressure regulator is arranged in the first return line. The second pressure regulator is provided in the second return line and adjusts fuel pressure to a lower level than the first pressure regulator does.

4 Claims, 3 Drawing Sheets

FUEL SUPPLY DEVICE FOR INTERNAL COMBUSTION ENGINE AND CONTROL DEVICE FOR THE FUEL SUPPLY DEVICE

FIELD OF THE INVENTION

The present invention relates to a fuel supply device for an internal combustion engine capable of changing fuel pressure to supply fuel to a fuel injection valve and to a control device for the fuel supply device.

BACKGROUND OF THE INVENTION

Patent Documents 1 and 2, for example, disclose a fuel supply devices that widen the dynamic range of fuel injection amount by changing fuel pressure.

The fuel supply device of Patent Document 1 supplies pressurized fuel from an end of a fuel branch pipe, which serves as a fuel distribution pipe, to an internal combustion engine through a supply line and returns excessive fuel from the other end of the fuel branch pipe to a fuel tank through a return line. The return line is branched into a line that has a low pressure regulating valve and an electromagnetic valve and a line that has a high pressure regulating valve only.

The fuel supply device of Patent Document 2 also supplies pressurized fuel from an end of a fuel gallery, which serves as a fuel distribution pipe, to the engine through a supply line. However, the fuel supply device does not include a return line through which excessive fuel is returned to a fuel tank. The supply line is branched into a line having a low pressure regulating valve and an electromagnetic valve and a line including a high pressure regulating valve only.

In the techniques of Patent Documents 1 and 2, the pressure of fuel in the fuel distribution pipe (the fuel branch pipe or the fuel gallery) rises when the electromagnetic valve closes and lowers when the electromagnetic valve opens. The level of the fuel pressure is regulated by controlling operation of the electromagnetic valve in accordance with the operating state of the engine (such as the throttle opening degree or the load on the engine).

In the device of Patent Document 1, the return line is connected to the end opposite to the end of the fuel branch pipe to which the supply line is connected. Accordingly, when the fuel injection amount is small as in a low load state or a low rotation state of the engine or fuel cutoff is carried out, a large amount of fuel that has been heated through the fuel branch pipe returns to the fuel tank via the return line, thus raising the temperature in the fuel tank.

Since the return line is not provided in the device of Patent Document 2, the heated fuel does not return to the fuel tank so that the fuel tank is not heated. However, since the fuel gallery cannot be cooled by the fuel that passes there through, the fuel may be injected through the fuel injection valve with fuel vapor generated in the fuel gallery if the engine is started at high temperature. If the fuel vapor is injected from the fuel injection valve, the amount of fuel falls short and hampers starting of the engine, lowers control the accuracy of the air-fuel ratio, or degrades the performance of the engine due to insufficient output. Also, if catalyst bed temperature control is performed on a catalyst provided in the exhaust system of the engine, the exhaust gas cannot be sufficiently enriched. Thus, the catalyst may be heated and melted.

Patent Document 1: Japanese Laid-Open Patent Document No. 5-59976

Patent Document 2: Japanese Laid-Open Patent Document No. 2001-221085

SUMMARY OF THE INVENTION

Accordingly, it is an objective of the present invention to provide a fuel supply device for an internal combustion engine and a control device for the fuel supply device that prevent a fuel tank from being heated when the engine is in a low load state or a low rotation state, and prevent insufficiency of fuel injection amount when the engine is started at high temperature.

To achieve the foregoing objective and in accordance with one aspect of the present invention, a fuel supply device is provided that supplies fuel from a fuel tank to a fuel distribution pipe of an internal combustion engine and injects the fuel from a fuel injection valve connected to the fuel distribution pipe. The device includes a main line, a fuel pump, a first return line, a second return line, a valve mechanism, a first pressure regulator, and a second pressure regulator. The main line extends from the fuel tank to the fuel distribution pipe. The fuel pump is arranged in the fuel tank or in the vicinity of the fuel tank, and pressurizes the fuel in the fuel tank and supplies the fuel to the main line. The first return line returns the fuel from the fuel distribution pipe to the fuel tank. The second return line is branched from the main line in the vicinity of the fuel pump and returns the fuel from the main line to the fuel tank. The valve mechanism is capable of selectively connecting and disconnecting the second return line with respect to the main line. The first pressure regulator is arranged in the first return line. The second pressure regulator is provided in the second return line and adjusts fuel pressure to a lower level than the first pressure regulator does.

DETAILED DESCRIPTION OF THE PREFERRED EMBODIMENTS

Figure 1:
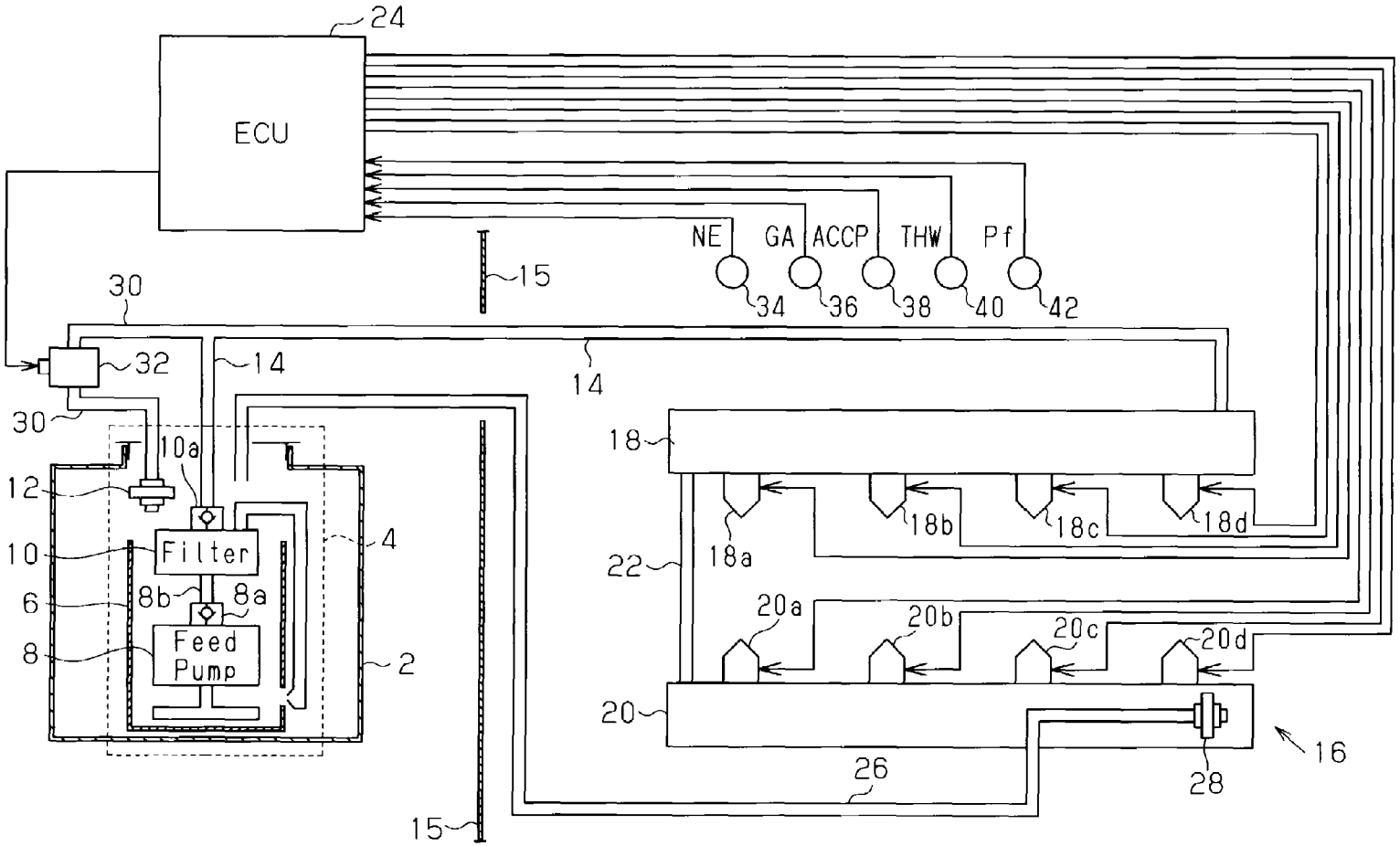
FIG. 1 is a schematic view showing a fuel supply device for an internal combustion engine and a control device for the fuel supply device according to one embodiment of the present invention.

FIG. 1 is a schematic view showing a fuel supply device for an internal combustion engine according to an embodiment of the present invention and a control device for the fuel supply device.

A fuel pump module 4 is arranged in a fuel tank 2. The fuel pump module 4 has a reservoir cup 6, an electric feed pump (corresponding to a fuel pump) 8, a fuel filter 10, and a low pressure regulator 12 (corresponding to a second pressure regulator). The reservoir cup 6 accommodates the feed pump 8 and the fuel filter 10. After having been pressurized by the feed pump 8, the fuel is sent to the fuel filter 10 through a check valve 8*a* and a fuel line 8*b* and then to a main line 14, or a fuel supply line, through a check valve 10*a*. The main line 14 extends through a cowl 15 and to a first fuel distribution pipe 18 and a second fuel distribution pipe 20, which are provided in an internal combustion engine (a gasoline engine for a vehicle) 16. The main line 14 sends pressurized fuel to the first and second fuel distribution pipes 18, 20. In the illustrated embodiment, the engine 16 is a V8 engine and has two banks each having a line of cylinders. The first fuel distribution pipe 18 and the second fuel distribution pipe 20, each of which is provided in correspondence with the associated one of the two banks (the two lines of the cylinders), are connected to each other at a communication line 22, thus forming a single joint body. In other words, the first fuel distribution pipe 18 and the second fuel distribution pipe 20 are connected together in such a manner as to function as an integral fuel distribution pipe.

After having been sent from the main line 14 to a first end of the first fuel distribution pipe 18, the fuel is fed to a first end of the second fuel distribution pipe 20 through the fuel communication line 22, which is connected to a second end of the first fuel distribution pipe 18. Four fuel injection valves 18*a*, 18*b*, 18*c*, 18*d* are connected to the first fuel distribution pipe 18 in correspondence with four cylinders. Fuel injection valves 20*a*, 20*b*, 20*c*, 20*d* are connected to the second fuel distribution pipe 20 in correspondence with four cylinders. In other words, the engine 16 has a total of eight fuel injection valves. In response to a signal from an electronic control unit (hereinafter, referred to as an ECU) serving as a control section, the fuel injection valves 18*a* to 18*d* and 20*a* to 20*d* inject fuel to the intake ports of the corresponding cylinders. A first return line 26 extending to the fuel tank 2 is connected to a second end of the second fuel distribution pipe 20, or the end opposite to the first end to which the fuel communication line 22 is connected.

Excessive fuel that has not been injected by the fuel injection valves 18*a* to 18*d* and 20*a* to 20*d* is returned to the fuel tank 2 through the first return line 26. The first return line 26 has a high pressure regulator 28 (corresponding to a first pressure regulator), which adjusts the pressure of the fuel to a high level (which is, for example, approximately 400 kPa). The excessive fuel is thus returned to the fuel tank 2 through the high pressure regulator 28 and the first return line 26.

A second return line 30 is branched from the main line 14 at a position adjacent to the fuel pump module 4 and extends to the fuel tank 2. The second return line 30 returns the fuel to the fuel tank 2 through the low pressure regulator 12. The low pressure regulator 12 adjusts the pressure of the fuel to a level (for example, approximately 280 kPa) lower than the level brought about by the high pressure regulator 28.

An electromagnetic valve (an on-off valve) 32 is arranged in the second return line 30 at a position upstream from the low pressure regulator 12 and outside the fuel tank 2. The electromagnetic valve 32 selectively opens and closes the second return line 30 in response to a signal from the ECU 24. The electromagnetic valve 32 is opened by receiving an ON signal from the ECU 24 and closed by receiving an OFF signal.

When the electromagnetic valve 32 is closed, the low pressure regulator 12 does not function. The pressure of the fuel in the main line 14 is thus adjusted to a high level by the high pressure regulator 28 without being switched to a low level by the low pressure regulator 12. Accordingly, the fuel is injected by the fuel injection valves 18*a* to 18*d* and 20*a* to 20*d* at high pressure at respective fuel injection timing. When the electromagnetic valve 32 is open, the low pressure regulator 12 adjusts the pressure of the fuel in the main line 14 to the low level in preference to the high pressure regulator 28. Accordingly, the fuel injection valves 18*a* to 18*d* and 20*a* to 20*d* inject the fuel at low pressure at the fuel injection timing. Through such ON-OFF control of the electromagnetic valve 32, the fuel pressure is easily switched between the high level and the low level.

The ECU 24 detects parameters indicating the operating state of the engine 16, such as the engine speed NE, the intake air amount GA, the accelerator pedal depression amount ACCP, the engine coolant temperature THW, and the fuel pressure PF by means of an engine speed sensor 34, an intake air amount sensor 36, a pedal depression amount sensor 38, a coolant temperature sensor 40, and a fuel pressure sensor 42. The ECU 24 performs computation procedures based on detection results of the parameters indicating the operating state of the engine 16 and various types of data that has been stored in advance. The ECU 24 thus controls the fuel injection amount and the fuel injection timing of the fuel injection valves 18*a* to 18*d* and 20*a* to 20*d* and operation of the electromagnetic valve 32.

Figure 2:
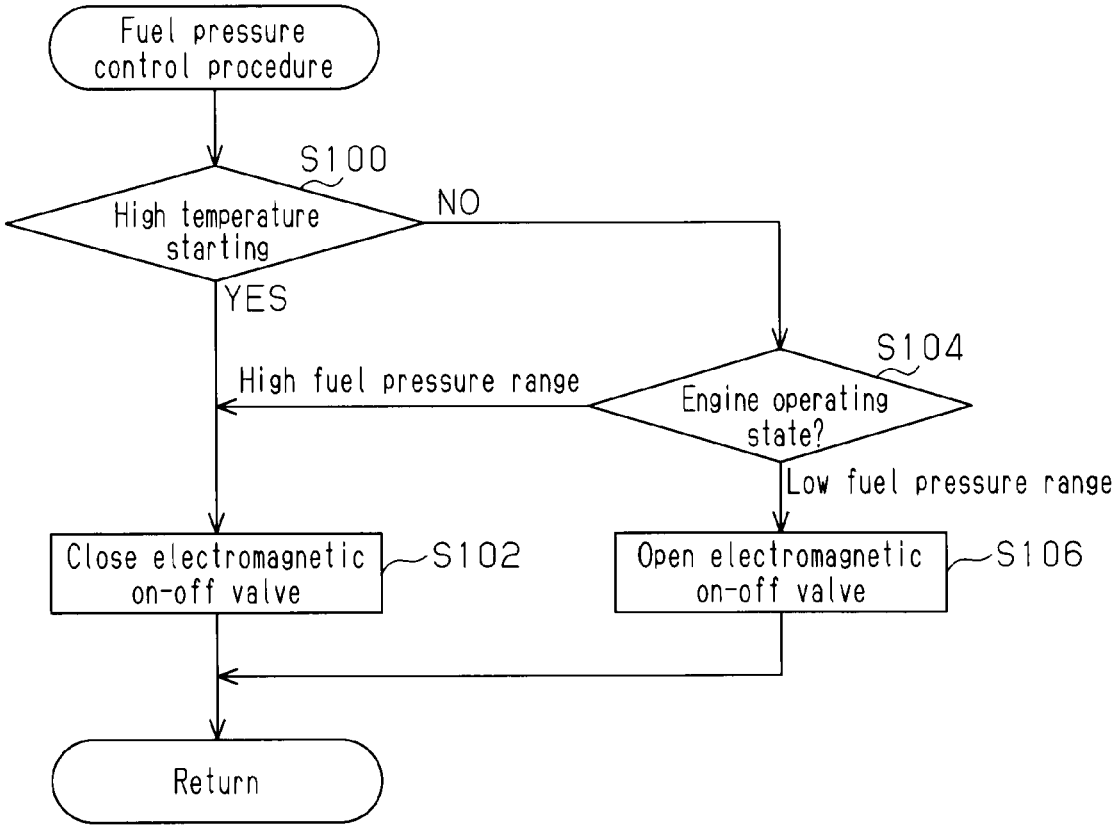
FIG. 2 is a flowchart representing a fuel pressure control procedure performed by the control device of FIG. 1.

Fuel pressure control performed by the ECU 24 will be explained in the following. FIG. 2 is a flowchart representing the fuel pressure control. The procedure is carried out in an interrupting manner each time a certain period of time elapses or each time the engine 16 rotates by a predetermined crank angle.

Once the procedure is started, the ECU 24 determines whether the engine 16 is in a high-temperature starting state (S100). Such determination is carried out based on the engine coolant temperature THW (alternatively, an oil temperature), which is detected by the coolant temperature sensor 40 when the engine 16 is started, or on the time elapsing from when the engine 16 is stopped to when the engine 16 is started. Specifically, if the engine coolant temperature THW is higher than a reference value by which it is determined that the engine 16 is in the high-temperature state, or the time elapsed since the engine 16 has been stopped is shorter than a reference value by which it is determined that the engine 16 has radiated heat to a sufficient extent, the ECU 24 determines that the engine 16 is in the high-temperature state and closes the electromagnetic valve 32 (S102). The procedure is then suspended.

By closing the electromagnetic valve 32 in step S102, the low pressure regulator 12 is prevented from influencing the fuel in the main line 14. The fuel supplied to the fuel distribution pipes 18, 20 is then adjusted to the high level by the high pressure regulator 28, which is arranged in the first return line 26. As a result, when the engine 16 is started at high temperature, the fuel injection valves 18*a* to 18*d* and 20*a* to 20*d* inject high-pressure fuel.

In this case, the excessive fuel that has not been injected from the fuel injection valves 18*a* to 18*d* and 20*a* to 20*d*, out of the fuel supplied from the main line 14 to the fuel distribution pipes 18, 20, is returned to the fuel tank 2 through the high pressure regulator 28 and the first return line 26 after passing through the fuel distribution pipes 18, 20. Accordingly, in the high-temperature starting state, the fuel distribution pipes 18, 20 are cooled by the fuel supplied from the fuel tank 2. Further, even if fuel vapor is generated in the fuel distribution pipes 18 20 due to the high temperature of the engine 16 when the engine 16 is stopped, the fuel vapor is sent out from the fuel distribution pipes 18, 20 to the fuel tank 2 through the first return line 26.

Contrastingly, if the engine 16 is not in the high-temperature starting state, the ECU 24 determines whether the operating state of the engine 16 is in a high pressure range, in which high-pressure fuel needs to be injected, or a low pressure range, in which low-pressure fuel needs to be injected (S104). The high pressure range is a range of the operating state in which the engine 16 is in a high rotation state or a high load state. The low pressure range is a range of the operating state other than the high pressure range. The level of the load on the engine is determined based on, for example, the intake air amount GA detected by the intake air amount sensor 36 or a requested fuel injection amount (volume of fuel per injection) or the pedal depression amount ACCP detected by the accelerator pedal depression amount sensor 38. Alternatively, the load on the engine may be determined by taking into consideration the increase rates of the intake air amount GA, the requested fuel injection amount, or the pedal depression amount ACCP.

If it is determined that the operating state of the engine 16 is in the low pressure range in step S104, the ECU 24 opens the electromagnetic valve 32 (S106). The procedure is then suspended.

By opening the electromagnetic valve 32 in step S106, the low pressure regulator 12 and the high pressure regulator 28 both act on the fuel in the main line 14. However, in reality, operation of the low pressure regulator 12 precedes operation of the high pressure regulator 28. In other words, the low pressure regulator 12 operates in preference to the high pressure regulator 28. The pressure of the fuel in the fuel distribution pipes 18, 20 is thus switched to the low level. As a result, the fuel is injected at low pressure from the fuel injection valves 18*a* to 18*d* and 20*a* to 20*d*.

In this case, the excessive fuel that has not been injected by the fuel injection valves 18*a* to 18*d* and 20*a* to 20*d* out of the fuel supplied from the feed pump 8 to the main line 14 through the fuel filter 10 is returned to the fuel tank 2 through the second return line 30, the electromagnetic valve 32, and the low pressure regulator 12 without flowing into the fuel distribution pipes 18, 20. Accordingly, a relatively large amount of fuel returned to the fuel tank 2 when the engine 16 is in the low load state or the low rotation state does not pass through the fuel distribution pipes 18, 20. This prevents heating of the fuel returned to the fuel tank 2. An excessive temperature rise thus does not occur in the fuel tank 2.

If it is determined that the operating state of the engine 16 is in the high pressure range in step S104, the ECU 24 closes the electromagnetic valve 32 (S102). The procedure is then suspended.

Through the procedure of step S102, the low pressure regulator 12 is prevented from acting on the fuel in the main line 14, as has been described. The fuel in the main line 14 is thus regulated by the high pressure regulator 28. Accordingly, high-pressure fuel is injected by the fuel injection valves 18*a* to 18*d* and 20*a* to 20*d*.

Also in this case, the excessive fuel that has not been injected from the fuel injection valves 18*a* to 18*d* and 20*a* to 20*d*, out of the fuel fed from the main line 14 to the fuel distribution pipes 18, 20, is returned to the fuel tank 2 through the high pressure regulator 28 and the first return line 26 after passing through the fuel distribution pipes 18, 20. However, since the engine 16 is in the high load state or the high rotation state, the amount of the fuel injected per unit time is great, and, correspondingly, the amount of the fuel returned to the fuel tank 2 is small. The temperature in the fuel tank 2 is thus prevented from rising.

As has been described, even if the opening periods of the fuel injection valves 18*a* to 18*d* and 20*a* to 20*d* per injection are equal, the injection amount per injection is adjusted by regulating the fuel pressure. Further, the injection amount per injection can be controlled by prolonging the opening period of each fuel injection valve 18*a* to 18*d* and 20*a* to 20*d* even if the injection amount per injection is small when the engine 16 is in the low load state or by shortening the opening period of the fuel injection valve 18*a* to 18*d* and 20*a* to 20*d* even if the injection amount per injection is great when the engine 16 is in the high load state. In this manner, the dynamic range of the fuel injection amount is widened.

Figure 3:
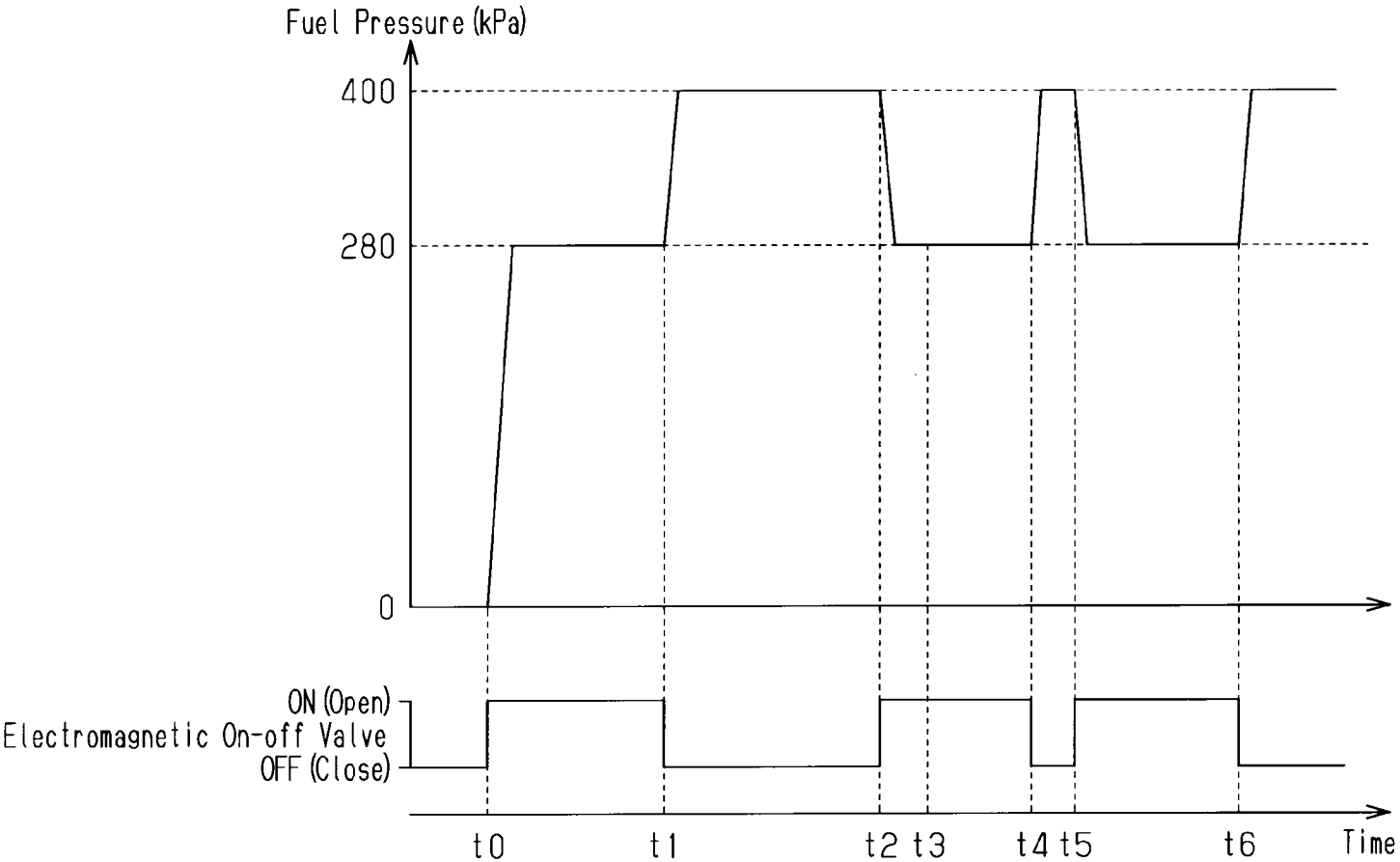
FIG. 3 is a timing chart representing an example of control executed by the control device of FIG. 1.

FIG. 3 is a timing chart representing an example of control according to the illustrated embodiment of the present invention. When the ignition switch is turned on at time point t0, the feed pump 8 is actuated. It is assumed that, at this stage, the engine 16 is not in the high-temperature starting state and the operating state of the engine 16 is in the low pressure range. In this case, the electromagnetic valve 32 is opened in response to an ON signal from the ECU 24 and the low pressure regulator 12 maintains the fuel pressure at the low level (t0 to t1).

Afterwards, if it is determined that the engine operating state is in the high pressure range at time point t1, the electromagnetic valve 32 is closed in response to an OFF signal from the ECU 24. The high pressure regulator 28 thus maintains the fuel pressure at the high level (t1 to t2).

Then, if it is determined that the engine operating state is in the low pressure range due to fuel cutoff (t2 to t3), the electromagnetic valve 32 is opened and the low pressure regulator 12 maintains the fuel pressure at the low level. Afterwards, the engine 16 is stopped at a certain time point between time point t3 to time point t4. When the engine 16 is started at high temperature at time point t4, or immediately after the engine 16 has been stopped, the electromagnetic valve 32 is temporarily closed and the fuel pressure rises (t4 to t5). From time point t5 at which high-temperature starting of the engine 16 is completed, the electromagnetic valve 32 is selectively opened (t5 to t6) and closed (from t6), in accordance with the engine operating state.

In the configuration illustrated in FIG. 1, the components other than the ECU 24 and the sensors 34 to 42 correspond to the fuel supply device. The ECU 24 corresponds to the control device controlling the fuel supply device.

The illustrated embodiment has the following advantages.

(1) In the illustrated embodiment, the main line 14 is connected to one end of the joint body of the fuel distribution pipes 18, 20 and the first return line 26 is connected to the other end of the joint body. The second return line 30 is branched from the main line 14 in the vicinity of the feed pump 8. The electromagnetic valve 32 is provided in the second return line 30.

When the engine 16 is in the low load state or the low rotation state in which an excessive amount of fuel may be supplied from the feed pump 8 and a great amount of fuel returns to the fuel tank 2, the electromagnetic valve 32 is opened so as to allow the second return line 30 to communicate with the main line 14. In this manner, the pressure of the fuel supplied from the feed pump 8 is lowered by the low pressure regulator 12, which is arranged in the second return line 30, and fed to the fuel distribution pipes 18, 20. Meanwhile, excessive fuel is returned from the second return line 30 to the fuel tank 2 through the low pressure regulator 12. Since the fuel pressure is decreased to the low level by the low pressure regulator 12, the pressure of the fuel in the fuel distribution pipes 18, 20 is prevented from reaching such a level that the fuel presses and opens the high pressure regulator 28 of the first return line 26. This prevents heated fuel from returning from the fuel distribution pipes 18, 20 to the fuel tank 2 via the first return line 26. As a result, the fuel tank 2 is not heated.

When the engine 16 is in the high-temperature starting state in which fuel vapor may be generated in the fuel distribution pipes 18, 20, the electromagnetic valve 32 is closed.

This causes the high pressure regulator 28 to raise the pressure of the fuel supplied from the feed pump 8 to the fuel distribution pipes 18, 20 through the main line 14. Meanwhile, excessive fuel is returned to the fuel tank 2 through the return line 26. Accordingly, through supply of the large amount of the fuel from the fuel tank 2, all or substantially all of the fuel in the fuel distribution pipes 18, 20 is sent out from the fuel distribution pipes 18, 20 to the fuel tank 2 via the first return line 26. This immediately lowers the temperature in each of the fuel distribution pipes 18, 20 and sends the fuel vapor out to the fuel tank 2, thus preventing the fuel vapor from being trapped in the fuel injection valves 18*a* to 18*d* and 20*a* to 20*d*. As a result, degradation of high-temperature starting performance caused by insufficiency of the fuel injection amount is suppressed.

As has been described, the illustrated embodiment prevents the fuel tank 2 from being heated when the engine 16 is in the low load state and prevents insufficiency of the fuel injection amount when the engine 16 is in the high-temperature starting state.

(2) Heating of the fuel tank 2 when the engine 16 is in the low load state and insufficiency of the fuel injection amount when the engine 16 is in the high-temperature starting state are easily prevented through control of operation of the electromagnetic valve 32 performed by the ECU 24 in accordance with the fuel pressure control procedure represented in FIG. 2.

The illustrated embodiment may be modified as follows.

The present invention may be used in an in-cylinder injection internal combustion engine, which injects fuel directly into a combustion chamber of the engine 16.

The feed pump 8 may be arranged at a position outside the fuel tank 2 and in the vicinity of the fuel tank 2.

In the second return line 30, the electromagnetic on-off valve 32 may be arranged downstream from the low pressure regulator 12.

The main line 14 and the first return line 26 may be connected to a portion closer to the center of the joint body of the two fuel distribution pipes 18, 20, instead of both ends of the joint body. Specifically, when excessive fuel is returned to the fuel tank 2 through the first return line 26 in the high-temperature starting state of the engine 16, some of the fuel may be exchanged between the two fuel distribution pipes 18, 20 to such an extent that insufficiency of the fuel injection amount caused by the fuel vapor does not occur.

The internal combustion engine 16 may be an engine other than the V8 engine, or an in-line engine having a single fuel distribution pipe.

The invention claimed is:

1. A fuel supply device that supplies fuel from a fuel tank to a fuel distribution pipe of an internal combustion engine and injects the fuel from a fuel injection valve connected to the fuel distribution pipe, the device comprising:

a main line extending from the fuel tank to the fuel distribution pipe;

a fuel pump that is arranged in the fuel tank or in the vicinity of the fuel tank, and pressurizes the fuel in the fuel tank and supplies the fuel to the main line;

a first return line that returns the fuel from the fuel distribution pipe to the fuel tank;

a second return line that is branched from the main line in the vicinity of the fuel pump and returns the fuel from the main line to the fuel tank;

a valve mechanism capable of selectively connecting and disconnecting the second return line with respect to the main line;

a control section which controls the valve mechanism;

a first pressure regulator arranged in the first return line;

a second pressure regulator that is provided in the second return line and adjusts fuel pressure to a lower level than the first pressure regulator does;

wherein, when the engine is in a high-temperature starting state, the control section controls the valve mechanism in such a manner as to disconnect the second return line from the main line, and wherein, when the engine is not in the high-temperature starting state, the control section determines whether the operating state of the engine is in a high pressure range, in which a high-pressure fuel needs to be injected, or in a low pressure range other than the high pressure range, controls the valve mechanism in such a manner as to disconnect the second return line from the main line when the operating state of the engine is in the high pressure range, and controls the valve mechanism in such a manner as to allow the second return line to communicate with the main line when the operating state of the engine is in the low pressure range.

2. The device according to claim 1, wherein the high pressure range is a range of the operating state in which the engine is in a high rotation state or a high load state.

3. The device according to claim 1, wherein the engine is in the high-temperature starting state based on engine coolant temperature detected by a coolant temperature sensor when the engine is started or time elapsed from when the engine is stopped to when the engine is started.

4. The device according to claim 2, wherein the control section determines the operating state of the engine based on an intake air amount detected by an intake air amount sensor, a request fuel injection amount or a pedal depression amount detected by an accelerator pedal depression amount sensor.

* * * * *